US007292258B2

(12) United States Patent
Noguchi et al.

(10) Patent No.: US 7,292,258 B2
(45) Date of Patent: Nov. 6, 2007

(54) MULTIBEAM SCANNING OPTICAL APPARATUS AND MULTIBEAM IMAGE FORMING APPARATUS

(75) Inventors: Kazuyoshi Noguchi, Toyokawa (JP); Hidekazu Takahama, Nagoya (JP); Takahiro Tsutsumi, Toyohashi (JP); Toru Maegawa, Hino (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 279 days.

(21) Appl. No.: 11/007,228

(22) Filed: Dec. 9, 2004

(65) Prior Publication Data

US 2006/0007042 A1 Jan. 12, 2006

(30) Foreign Application Priority Data

Jul. 7, 2004 (JP) ..... 2004-200791

(51) Int. Cl.
*B00D 447/00* (2006.01)
*B41J 2/45* (2006.01)

(52) U.S. Cl. ..... 347/132; 347/237

(58) Field of Classification Search ..... 347/129, 347/130, 132, 233, 237
See application file for complete search history.

(56) References Cited

U.S. PATENT DOCUMENTS 6,249,306 B1 6/2001 Isono et al.
2006/0017410 A1* 1/2006 Noguchi et al. ..... 315/382

FOREIGN PATENT DOCUMENTS

| | | |
|---|---|---|
| JP | 05-006077 | 1/1993 |
| JP | 2000-43317 | 2/2000 |
| JP | 2000-180751 | 6/2000 |
| JP | 2001-091871 | 4/2001 |
| JP | 2001-353897 A | 12/2001 |

OTHER PUBLICATIONS

Machine-generated translation of JP 2001-353897 cited in the IDS filed on Dec. 9, 2004.*
A Notification of Grounds for rejection issued in corresponding Japanese Patent Application No. 2004-200791, and translation thereof.

* cited by examiner

*Primary Examiner*—Huan Tran
(74) *Attorney, Agent, or Firm*—Buchanan Ingersoll & Rooney PC

(57) ABSTRACT

A multibeam scanning optical apparatus incluses a controller which specifies laser diodes which are emitting light normally and arranged in a continuous row, a memory having a plurality of area in which image data are stored, a write-in controller which causes image data for each line to be written into only areas of memory corresponding to the specified laser diodes when any of the laser diodes suffers a failure, a read-out controller which causes the image data for each line to be read out simultaneously from the areas of memory corresponding to the specified laser diodes and a driver which performs light emission control only with respect to the specified laser diodes.

9 Claims, 4 Drawing Sheets

MULTIBEAM SCANNING OPTICAL APPARATUS AND MULTIBEAM IMAGE FORMING APPARATUS

This application is based on Japanese Patent Application (s) No.(s). 2004-200791 filed in Japan on Jul. 7, 2004, the entire content of which is hereby incorporated by reference.

BACKGROUND OF THE INVENTION

1. Field of the Invention

The present invention relates to a multibeam scanning optical apparatus and a multibeam image forming apparatus. It particularly relates to a multibeam scanning optical apparatus and a multibeam image forming apparatus for forming an image on a photosensitive member by irradiating the photosensitive member with a plurality of beams at predetermined intervals in the secondary scanning direction.

2. Description of Related Art

Recently, in the field of an image forming apparatus utilizing electrophotography, there are provided various multibeam image forming apparatuses for forming an electrostatic latent image on a photosensitive member by using a scanning optical unit incorporating an array of light emitting elements capable of emitting a plurality of beams simultaneously. In such an apparatus, the number of revolutions of a deflector (polygon mirror) and the pixel clock frequency are suppressed by simultaneously emitting a plurality of beams at predetermined intervals in the secondary scanning direction, and the system speed is increased to improve the print productivity per unit time.

However, when at least one of the light emitting elements suffers a failure, the use of the multibeam light emitting element array while enjoying its original function is impossible. In such a case, the operation of the apparatus need be stopped, and the scanning optical unit need be replaced.

To solve the above problem, in the image forming apparatus disclosed in Japan Patent Laid Open Publication No. 2001-353897, image forming for a text document is continued even when one of the multibeam light emitting elements suffers a light emission failure, because such a lack of one beam does not exert a significant influence on the outputted image. In the disclosed apparatus, on the other hand, image forming for a photo document is not allowed when such a failure occurs, because it causes a noticeable defect on the outputted image.

In the above image forming apparatus, however, an image is formed while lacking one beam. Therefore, even in the case of a text document, deterioration in the outputted image is inevitable. Further, since the image forming operation cannot be continued in the case of a photo document, the apparatus cannot be used for an urgent matter. Furthermore, the apparatus cannot address the situation in which a plurality of beams are lacked. Moreover, the failure in just one of the light emitting elements eventually necessitates the replacement of the scanning optical unit, which is not economical.

OBJECT AND SUMMARY

It is, therefore, an object of the present invention to provide a multibeam scanning optical apparatus and a multibeam image forming apparatus which are capable of maintaining the resolution even when at least one of a plurality of beam generating elements suffers a failure by using beam generating elements which operate normally.

Another object of the present invention is to provide a multibeam scanning optical apparatus and a multibeam image forming apparatus which are capable of continuing image forming without considerably reducing the print productivity.

To achieve the above objects, according to a first aspect of the present invention, there is provided a multibeam scanning optical apparatus for forming an image on a photosensitive member by irradiating the photosensitive member with beams at predetermined intervals in a secondary scanning direction, the beams being emitted from a plurality of beam generating elements spaced at predetermined intervals in a direction, the apparatus comprising a plurality of memory portions each for storing image data for a respective one of the beam generating elements line by line, a determiner for checking the light emission state as to whether each of the beam generating elements operates normally or suffers a failure and specifying the beam generating elements operating normally and arranged in a continuous row which is the largest in number of beam generating elements when at least one of the beam generating elements suffers a failure, a memory controller for controlling writing and reading of image data with respect to the memory portions, the memory controller causing the image data to be written in and read out successively line by line only with respect to the memory portions corresponding to the specified beam generating elements when the beam generating elements operating normally and arranged in a continuous row are specified by the determiner, a driver for controlling the light emission of the beam generating elements, the driver performing the light emission control only with respect to the specified beam generating elements when the beam generating elements operating normally and arranged in a continuous row are specified by the determiner, a deflector controller for controlling the number of revolutions of a deflector for deflecting and scanning a plurality of beams, the deflector controller being capable of changing the number of revolutions of the deflector depending on the number of the specified beam generating elements when the beam generating elements operating normally and arranged in a continuous row are specified by the determiner and a pixel clock controller for controlling a pixel clock frequency, the pixel clock controller being capable of changing the pixel clock frequency depending on the number of the specified beam generating elements when the beam generating elements operating normally and arranged in a continuous row are specified by the determiner.

In the multibeam scanning optical apparatus according to the first aspect of the present invention, after the initial state in which all the beam generating elements operate normally, when at least one of the beam generating elements suffers a failure (including deterioration) and the determiner specifies the beam generating elements operating normally and arranged in a continuous row, image forming on the photosensitive member is performed while driving the specified beam generating elements only. At this time, the system speed at the initial state is maintained, while the number of revolutions of the deflector and the pixel clock frequency are changed depending on the number of the specified beam generating elements. By such control, image forming can be continued by using only the normally operating beam generating elements without reducing the resolution and the print productivity.

According to a second aspect of the present invention, there is provided a multibeam image forming apparatus for forming an image on a photosensitive member by irradiating the photosensitive member with beams at predetermined intervals in a secondary scanning direction, the beams being emitted from a plurality of beam generating elements spaced at predetermined intervals in a direction, the apparatus comprising a plurality of memory portions each for storing image data for a respective one of the beam generating elements line by line, a determiner for checking the light emission state as to whether each of the beam generating elements operates normally or suffers a failure and specifying the beam generating elements operating normally and arranged in a continuous row which is the largest in number of beam generating elements when at least one of the beam generating elements suffers a failure, a memory controller for controlling writing and reading of image data with respect to the memory portions, the memory controller causing the image data to be written in and read out successively line by line only with respect to the memory portions corresponding to the specified beam generating elements when the beam generating elements operating normally and arranged in a continuous row are specified by the determiner, a driver for controlling the light emission of the beam generating elements, the driver performing the light emission control only with respect to the specified beam generating elements when the beam generating elements operating normally and arranged in a continuous row are specified by the determiner and a system speed controller for controlling system speed of the image forming apparatus, the system speed controller being capable of changing the system speed depending on the number of the specified beam generating elements when the beam generating elements operating normally and arranged in a continuous row are specified by the determiner.

In the multibeam image forming apparatus according to the second aspect of the present invention, after the initial state in which all the beam generating elements operate normally, when at least one of the beam generating elements suffers a failure (including deterioration) and the determiner specifies the beam generating elements operating normally and arranged in a continuous row, image forming on the photosensitive member is performed while driving the specified beam generating elements only. At this time, the number of revolutions of the deflector and the pixel clock frequency are maintained at the initial values, while the system speed is changed depending on the number of the specified beam generating elements. By such control, image forming can be continued by using only the normally operating beam generating elements without reducing the resolution and without considerably reducing the print productivity.

According to a third aspect of the present invention, a multibeam image forming apparatus for forming an image on a photosensitive member by irradiating the photosensitive member with beams at predetermined intervals in a secondary scanning direction, the beams being emitted from a plurality of beam generating elements spaced at predetermined intervals in a direction, the apparatus comprising a plurality of memory portions each for storing image data for a respective one of the beam generating elements line by line, a determiner for checking the light emission state as to whether each of the beam generating elements operates normally or suffers a failure and specifying the beam generating elements operating normally and arranged in a continuous row which is the largest in number of beam generating elements when at least one of the beam generating elements suffers a failure, a memory controller for controlling writing and reading of image data with respect to the memory portions, the memory controller causing the image data to be written in and readout successively line by line only with respect to the memory portions corresponding to the specified beam generating elements when the beam generating elements operating normally and arranged in a continuous row are specified by the determiner, a driver for controlling the light emission of the beam generating elements, the driver performing the light emission control only with respect to the specified beam generating elements when the beam generating elements operating normally and arranged in a continuous row are specified by the determiner, a deflector controller for controlling the number of revolutions of a deflector for deflecting and scanning a plurality of beams, the deflector controller being capable of changing the number of revolutions of the deflector depending on the number of the specified beam generating elements when the beam generating elements operating normally and arranged in a continuous row are specified by the determiner, a pixel clock controller for controlling a pixel clock frequency, the pixel clock controller being capable of changing the pixel clock frequency depending on the number of the specified beam generating elements when the beam generating elements operating normally and arranged in a continuous row are specified by the determiner and a system speed controller for controlling system speed of the image forming apparatus, the system speed controller being capable of changing the system speed depending on the number of the specified beam generating elements when the beam generating elements operating normally and arranged in a continuous row are specified by the determiner.

In the multibeam image forming apparatus according to the third aspect of the present invention, after the initial state in which all the beam generating elements operate normally, when at least one of the beam generating elements suffers a failure (including deterioration) and the determiner specifies the beam generating elements operating normally and arranged in a continuous row, image forming on the photosensitive member is performed while driving the specified beam generating elements only. Basically, at this time, the system speed at the initial state is maintained, while the number of revolutions of the deflector and the pixel clock frequency are changed depending on the number of the specified beam generating elements. By such control, image forming can be continued by using only the normally operating beam generating elements without reducing the resolution and the print productivity.

Specifically, when the determiner specifies the beam generating elements operating normally and arranged in a continuous row, the pixel clock frequency and the number of revolutions of the deflector are controlled based on the formulae (1), (2) given below, while the initial system speed is maintained.

$$\text{Pixel clock frequency} = \text{Initial pixel clock frequency} \times (m/a) \quad (1)$$

$$\text{Number of revolutions of deflector} = \text{Initial number of revolutions} \times (m/a) \quad (2)$$

where "m" represents the number of beam generating elements arranged in advance, and "a" represents the number of beam generating elements which are operating normally and arranged in a continuous row.

As noted above, such control makes it possible to continue image forming by using only the normally operating laser diodes without reducing the resolution and the print productivity.

When the value obtained by the formula (1) exceeds a maximum rated pixel clock frequency or when the value obtained by the formula (2) exceeds the maximum rated number of revolutions of the deflector, the pixel clock frequency and the number of revolutions of the deflector are maintained at the initial values, and the system speed is controlled based on the formula (3) given below:

$$\text{System speed}=\text{Initial system speed}\times(a/m) \quad (3)$$

Although such control of the system speed reduces the print productivity, image forming can be continued by using only the normally operating beam generating elements without reducing the resolution. In the case where the aimed print productivity cannot be achieved when the system speed is changed from the initial value in the above manner, it is preferable to notify that the service maintenance is necessary. To perform image forming with the print productivity reduced below the aimed spec is merely temporary measures.

On the other hand, in the case where the determiner specifies the beam generating elements operating normally and arranged in a continuous row and the aimed print productivity can be achieved even when the system speed is controlled based on the above formula (3) where "m" represents the number of beam generating elements arranged in advance while "a" representing the number of beam generating elements which are operating normally and arranged in a continuous row, the system speed may be controlled based on the formula (3) while the pixel clock frequency and the number of revolutions of the deflector are maintained at the initial values.

By such control, image forming can be continued by using only the normally operating laser diodes without reducing the resolution. Although the print productivity may be reduced slightly, the aimed print productivity can be achieved.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

Preferred embodiments of a multibeam scanning optical apparatus and a multibeam image forming apparatus according to the present invention will be described below with reference to the accompanying drawings.

Figure 1:
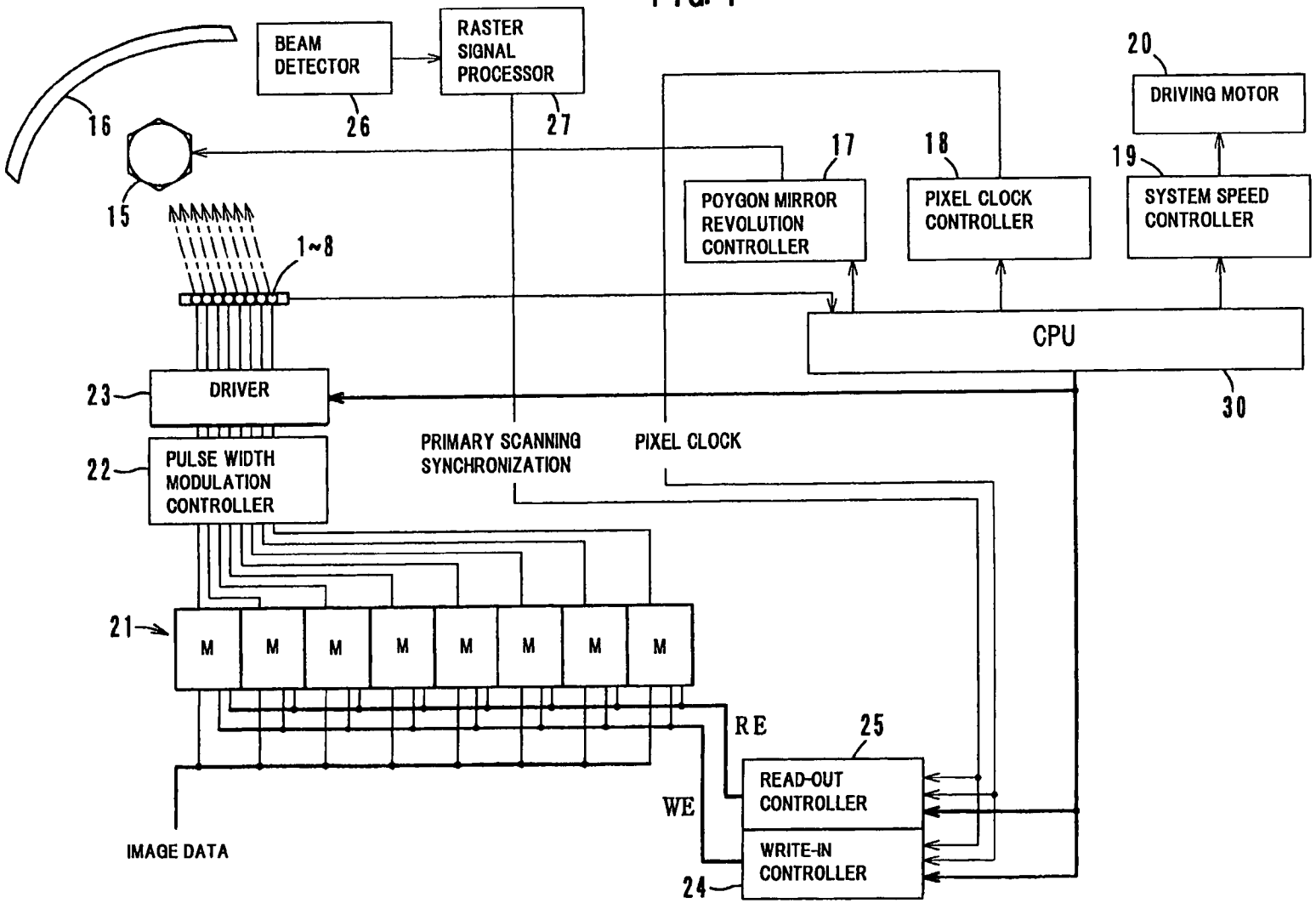
FIG. 1 is a block diagram showing a multibeam scanning optical apparatus as an embodiment of the present invention, along with a principal portion of an image forming apparatus.

FIG. 1 shows a multibeam scanning optical apparatus as an embodiment of the present invention, along with a principal portion of an image forming apparatus. The multibeam scanning optical device employs a system for forming an image on a non-illustrated photosensitive drum by irradiating the drum simultaneously with eight beams at predetermined intervals in the secondary scanning direction. As will be described later in detail, when emission failure occurs in any of the beams (hereinafter referred to as "during emission failure"), image forming is performed by utilizing normal beams only.

The eight beams are emitted from an array of laser diodes 1–8, deflected for scanning in the primary scanning direction by the constant speed revolution of a polygon mirror 15, and then irradiate on the photosensitive drum via e.g. a scan lens 16, thereby forming a two-dimensional electrostatic latent image on the drum. It is to be noted that, since a tandem image forming process, in which images (toner images) formed on a plurality of photosensitive drums are combined on an intermediate transfer belt, and then transferred onto a sheet for fixation is well known, the description thereof is omitted.

The number of revolutions of the polygon mirror 15 is controlled by a revolution controller 17. Specifically, the number of revolutions is controlled to the initial value when all the laser diodes 1–8 are emitting light normally, whereas the number of revolutions is controlled to the value which will be described below during emission failure.

A pixel clock controller 18 controls the pixel clock frequency which serves as a base for image formation. Specifically, the pixel clock frequency is controlled to the initial value when all the laser diodes 1–8 are emitting light normally, whereas the pixel clock frequency is controlled to the value which will be described below during emission failure.

The system speed of the image forming apparatus, i.e. the peripheral speed of the photosensitive drum and the sheet transfer speed are controlled by changing the number of revolutions of a driving motor 20 by a system speed controller 19. Specifically, by the system speed controller 19, the system speed is controlled to the initial value when all the laser diodes 1–8 are emitting light normally, whereas the system speed is controlled to the value which will be described below during emission failure.

The system speed defines the number of sheets to be printed per unit time (print productivity). When the aimed print productivity cannot be achieved (when lower than the minimum system speed), a call for service maintenance is displayed on a control panel of the image forming apparatus.

A memory unit 21 comprises eight memories respectively storing image data for the laser diodes 1–8 line by line. When the laser diodes 1–8 are emitting light normally, data for one line of an image is successively written into each of the memories every time a write-in controller 24 outputs a write-in signal WE. Further, when a read-out controller 25 outputs a read-out signal RE, data for one line of an image is read out from each of the memories.

The write-in signal WE and the read-out signal RE are outputted respectively from the write-in controller 24 and the read-out controller 25 based on a primary scanning synchronization signal outputted based on the detection results of a beam detector 26, which serves to detect emitted beams, via a raster signal processor 27.

The image data read from the memory unit 21 is transferred to a driver 23 through a pulse width modulation controller 22, and the driver 23 controls light emission of the laser diodes 1–8.

A determiner, which is incorporated in a CPU 30 for controlling the entirety of the image forming apparatus, directly checks the light emission state of each of the laser diodes 1–8 and determines whether each of the laser diodes operates normally or suffers a failure (including deterioration of an element). When at least one of the laser diodes suffers a failure, the determiner specifies the laser diodes operating normally and arranged in a continuous row which is the largest in number of laser diodes. The determination result is outputted to the polygon mirror revolution controller 17, the pixel clock controller 18, the system speed controller 19, the driver 23, the write-in controller 24 and the read-out controller 25.

Figure 2:
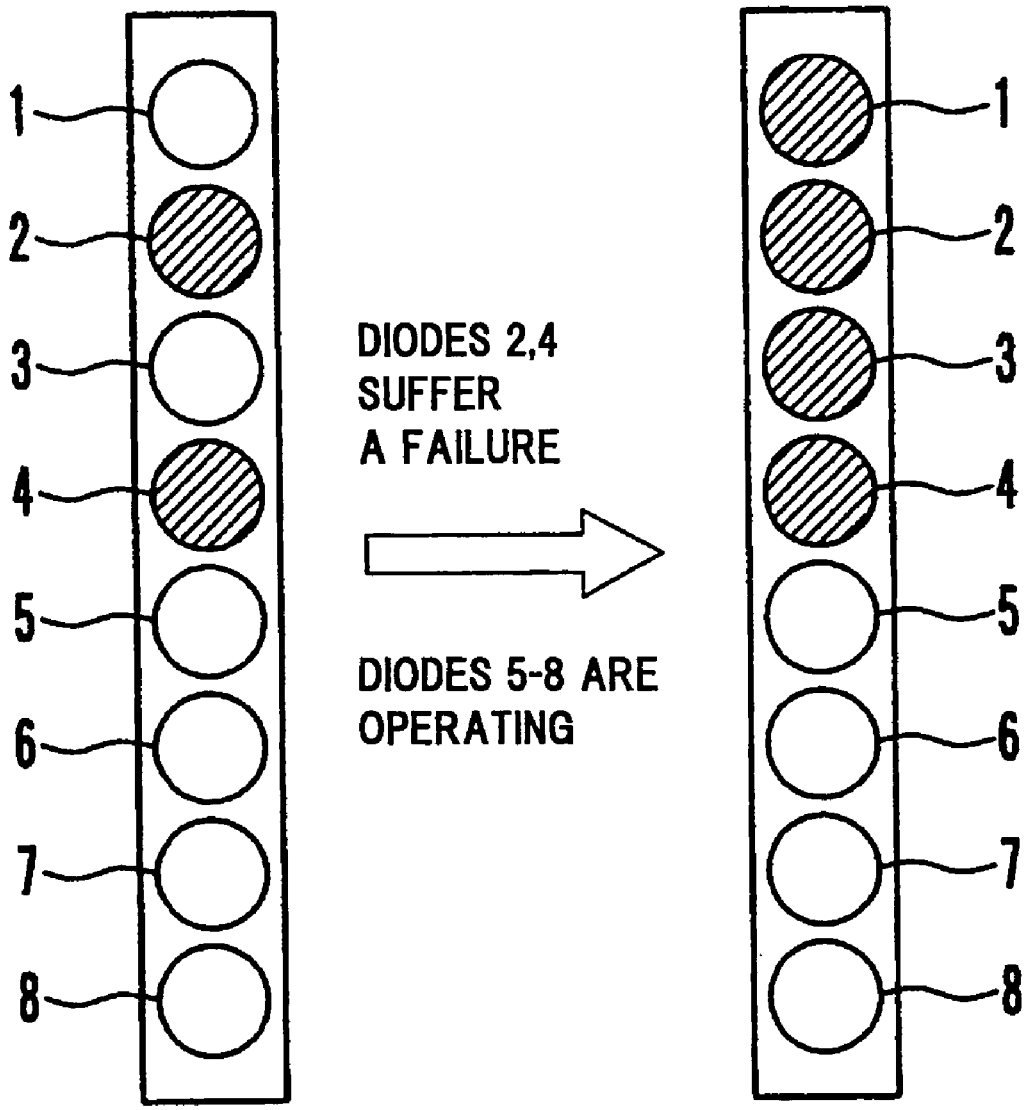
FIG. 2 illustrates a first example of light emission state of laser diodes.
Figure 3:
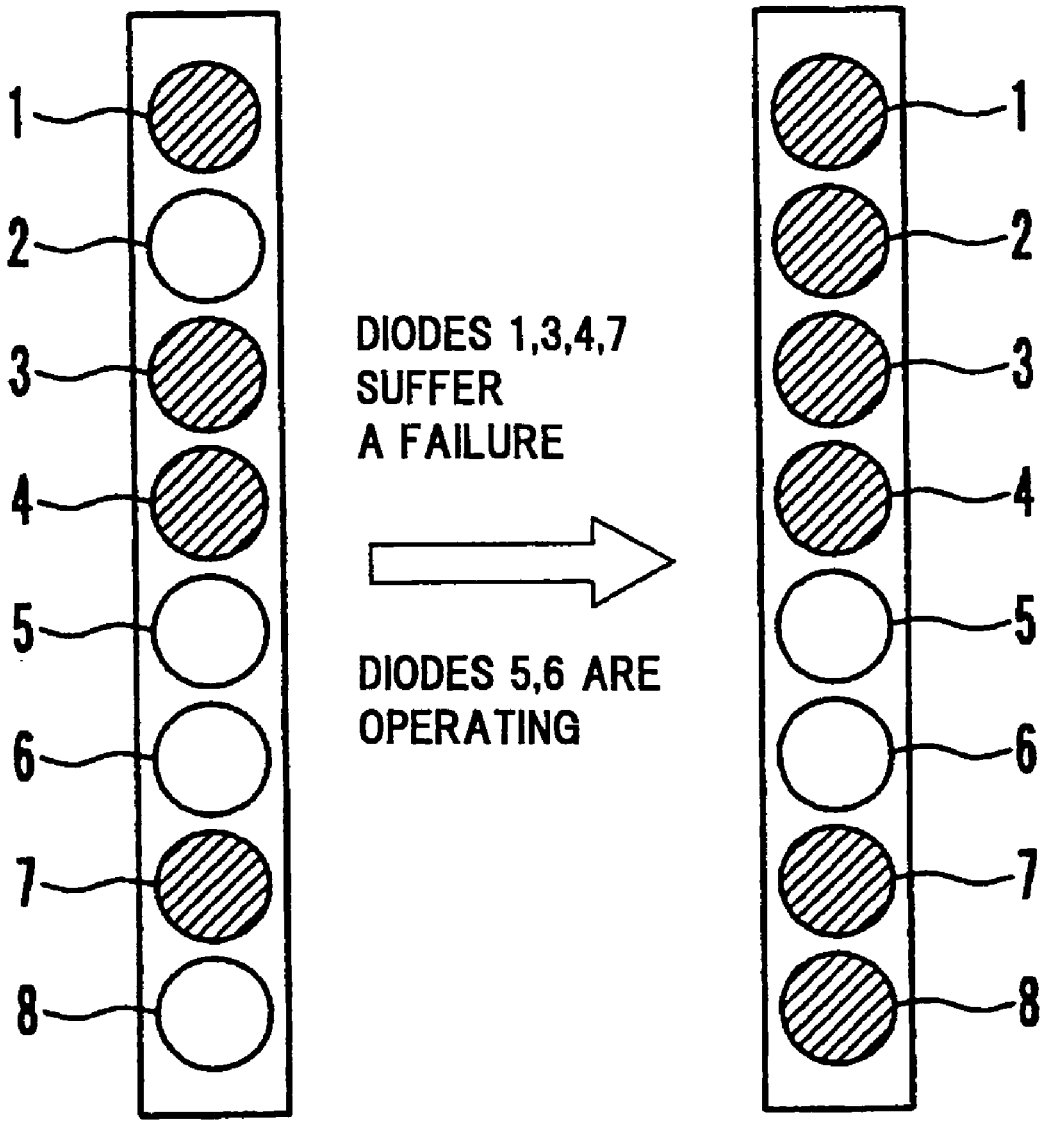
FIG. 3 illustrates a second example of light emission state of laser diodes.

When any of the laser diodes 1–8 suffers a failure, the CPU 30 (determiner) specifies the laser diodes which are emitting light normally and arranged in a continuous row which is the largest in number of laser diodes. For example, as shown in FIG. 2, when the laser diodes 2, 4 suffer a failure, the laser diodes 5–8 which are operating normally and arranged in a continuous row which is the largest in number of laser diodes, are specified. As shown in FIG. 3, when the laser diodes 1, 3, 4, 7 suffer a failure, the laser diodes 5 and 6 which are operating normally and arranged in a continuous row which is the largest in number of laser diodes are specified.

During such emission failure, the write-in controller 24 causes the image data for each line to be written into only the memories corresponding to the specified laser diodes. The read-out controller 25 causes the image data for each line to be read out simultaneously from the memories corresponding to the specified laser diodes. The driver 23 performs light emission control only with respect to the specified laser diodes.

Specifically, when the laser diodes which are emitting light normally and arranged in a continuous row are specified by the CPU 30 (determiner), the pixel clock frequency and the number of revolutions of the polygon mirror are controlled based on the formulae (1), (2) given below while the initial system speed is maintained. Note that in the formulae below, "m" represents the number of laser diodes arranged in advance (initial number of beams), whereas "a" represents the number of specified laser diodes which are emitting light normally and arranged in a continuous row (number of beams used during emission failure).

$$\text{Pixel clock frequency}=\text{Initial pixel clock frequency}\times(m/a) \quad (1)$$

$$\text{Number of revolutions of polygon mirror}=\text{Initial number of revolutions}\times(m/a) \quad (2)$$

By such control, image forming can be continued by using only the normally operating laser diodes without reducing the resolution and the print productivity.

When the value obtained by the formula (1) exceeds the maximum rated pixel clock frequency or when the value obtained by the formula (2) exceeds the maximum rated number of revolutions of the polygon mirror, the pixel clock frequency and the number of revolutions of the polygon mirror are maintained at the initial values, and the system speed is controlled based on the formula (3) given below.

$$\text{System speed}=\text{Initial system speed}\times(a/m) \quad (3)$$

Although the above control of the system speed reduces the print productivity, image forming can be continued by using only the normally operating laser diodes without reducing the resolution.

On the other hand, in the case where the aimed print productivity can be achieved even when the system speed is controlled based on the above formula (3), the system speed may be controlled based on the formula (3) while the pixel clock frequency and the number of revolutions of the deflector are maintained at respective initial values.

By such control, image forming can be continued by using only the normally operating laser diodes without reducing the resolution. Although the print productivity may be reduced slightly, the aimed print productivity can be achieved.

In the foregoing embodiment, when at least one of the laser diodes 1–8 suffers a failure, the pixel clock frequency and the number of revolutions of the polygon mirror are changed as a priority. The reason for this, i.e., the reason why it is not preferable to set the system speed to be higher than the initial value is as follows.

First, when the system speed is increased over the initial value, the interval between sheets in passing the sheets is reduced, which increases the possibility of an error in feeding and transferring sheets. Secondly, in the case of the tandem system, photosensitive drums for forming cyan, magenta, yellow and black images, respectively, are brought into contact with an intermediate transfer belt in forming a color image. In forming a black image, the photosensitive drums for forming cyan, magenta and yellow images are separated from the intermediate transfer belt, while only the photosensitive belt for forming a black image is kept in contact with the intermediate transfer belt. Since such positional change is performed between images, the interval between sheets in passing the sheets need be set as large as possible.

Figure 4:
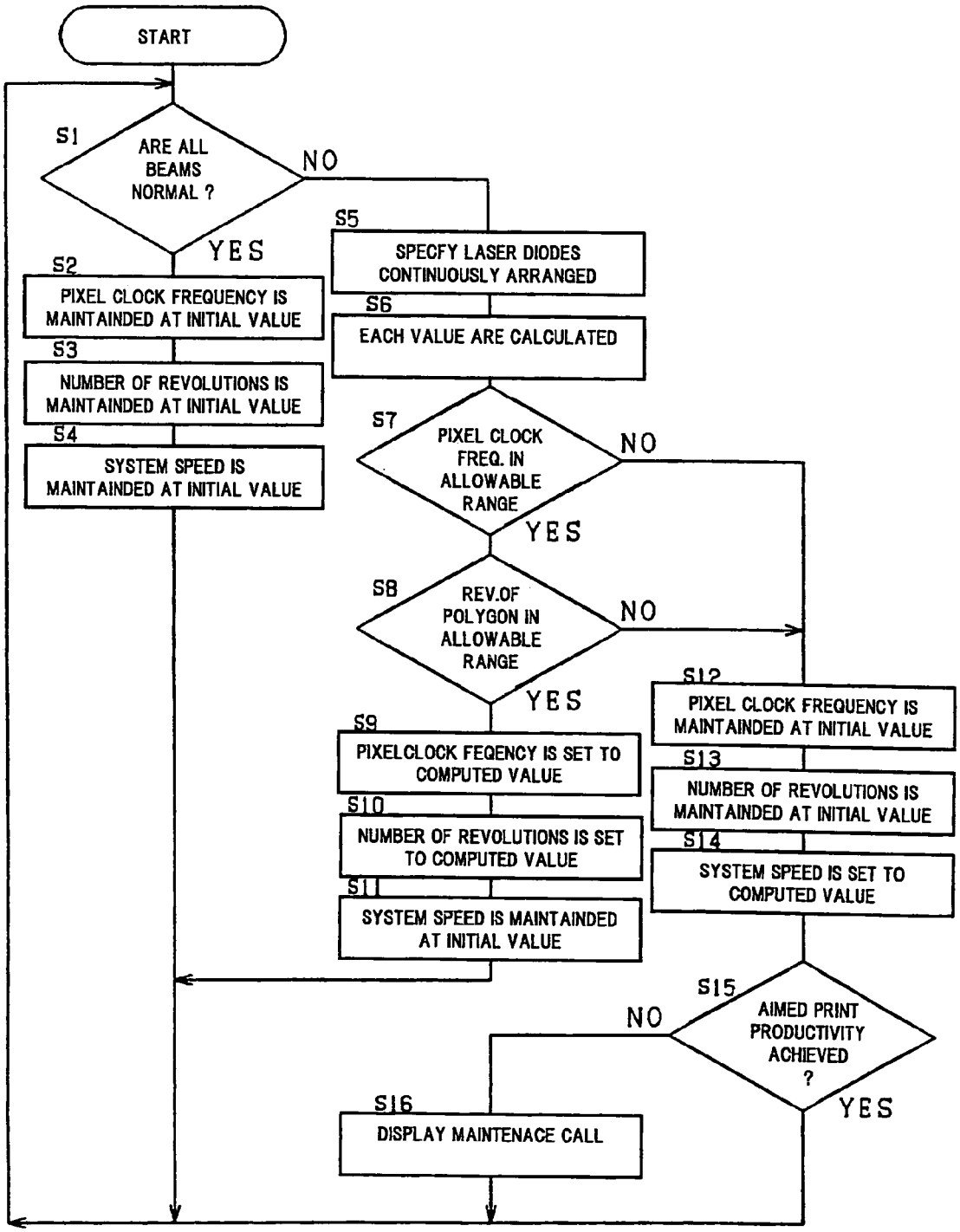
FIG. 4 is a flowchart showing an example of control of the image forming apparatus.

An example of control of the image forming apparatus by the CPU 30 will be described below with reference to the flowchart shown in FIG. 4.

First, in Step S1, whether or not all the beams from the laser diodes 1–8 are normal is determined. When all the beams are normal, the pixel clock frequency, the number of revolutions of the polygon mirror and the system speed are maintained at the initial values in Steps S2, S3 and S4, respectively, and this routine is finished.

When any of the beams suffers a failure (NO in Step S1), the laser diodes 1–8 which are arranged continuously are specified in Step S5. Based on the specifying result, the pixel frequency, the number of revolutions of the polygon mirror, and the system speed are computed in Step S6.

Subsequently, the computed pixel clock frequency and the computed number of revolutions of the polygon mirror are checked in Steps S7 and S8, respectively, as to whether or not each of the computed values lies in the allowable range of the maximum rated value. When both of the computed values lie in the respective allowable ranges, the pixel clock frequency is set to the computed value in Step S9, and the number of revolutions of the polygon mirror is set to the computed value in Step S10. In Step S11, the system speed is maintained at the initial value.

On the other hand, when either of the computed pixel clock frequency and the computed number of revolutions of the polygon mirror does not lie in the allowable range (NO in Step S7 or Step S8), the pixel clock frequency is maintained at the initial value in Step S12, and the number of revolutions of the polygon mirror is maintained at the initial value in Step S13. Subsequently, in Step S14, the system speed is set to the computed value.

Subsequently, in Step S15, determination is made as to whether or not the system speed which has been set can achieve the aimed print productivity. When the productivity can be achieved, this routine is finished. When the productivity cannot be achieved, a maintenance call is displayed on the control panel in Step S16, and this routine is finished.

Embodiment

Herein, as Embodiment 1, the control during emission failure in an image forming apparatus of the spec given in Table 1 below will be described.

TABLE 1

| | |
|---|---|
| Initial number of beams m | Eight |
| Print productivity | 80 sheets/min. |
| Initial pixel clock frequency | 15 MHz |
| Maximum rated pixel clock frequency | 100 MHz |
| Initial number of polygon mirror revolutions | 9900 rpm |
| Maximum rated number of polygon mirror revolutions | 45000 rpm |
| Initial system speed | 400 mm/s |
| Minimum system speed | 283 mm/s |

With respect to the image forming apparatus of the spec in Table 1, the values after change of the pixel clock frequency and number of polygon mirror revolutions were computed based on the formulae (1), (2), the results of which are given in Table 2 below.

TABLE 2

| Number of beams used during emission failure | Pixel clock frequency after change (MHz) | Number of polygon mirror revolutions after change (rpm) | System speed (mm/s) |
|---|---|---|---|
| 7 | 17.14 | 11314 | 400 |
| 6 | 20 | 13200 | 400 |
| 5 | 24 | 15840 | 400 |
| 4 | 30 | 19800 | 400 |
| 3 | 40 | 26400 | 400 |
| 2 | 60 | 39600 | 400 |

As will be understood from Table 2, in any of the cases in which the number of used beams a is 7, 6, 5, 4, 3, 2, the pixel clock frequency and number of polygon mirror revolutions after change do not exceed the maximum rated frequency of 100 MHz and the maximum rated number of revolutions of 45000 rpm, respectively. Therefore, by this control, image forming can be continued without reducing the print productivity and the resolution while the initial system speed of 400 mm/s is maintained.

During emission failure, the system speed may be changed to the values given in Table 3 below while the pixel clock frequency and the number of polygon mirror revolutions are maintained at the initial values.

TABLE 3

| Number of beams used during emission failure | Pixel clock frequency after change (MHz) | Number of polygon mirror revolutions after change (rpm) | System speed (mm/s) |
|---|---|---|---|
| 7 | 15 | 9900 | 350 |
| 6 | 15 | 9900 | 300 |
| 5 | 15 | 9900 | 250 |
| 4 | 15 | 9900 | 200 |
| 3 | 15 | 9900 | 150 |
| 2 | 15 | 9900 | 100 |

In Embodiment 1, the minimum system speed capable of achieving the print productivity of 80 sheets/min. is 283 mm/s. Therefore, in the cases where the number a of used beams is seven and six, the aimed print productivity can be achieved even when image forming is continued with the system speed alone reduced to 350 mm/s and 300 mm/s, respectively. However, when the number a of used beams is five or less, the system speed drops below the minimum speed of 283 mm/s. Such control is not preferable, because the aimed print productivity cannot be achieved.

Next, the spec of Embodiment 2 is given in Table 4 below.

TABLE 4

| | |
|---|---|
| Initial number of beams m | Eight |
| Print productivity | 80 sheets/min. |
| Initial pixel clock frequency | 15 MHz |
| Maximum rated pixel clock frequency | 40 MHz |
| Initial number of polygon mirror revolutions | 9900 rpm |
| Maximum rated number of polygon mirror revolutions | 20000 rpm |
| Initial system speed | 400 mm/s |
| Minimum system speed | 283 mm/s |

In Embodiment 2, the maximum rating of the pixel clock frequency is 40 MHz, whereas the maximum rating of the number of revolutions of the polygon mirror is 20000 rpm. As is clear from Table 2, in the case where the initial system speed of 400 mm/s is maintained, the number of polygon mirror revolutions after change (26400 rpm) exceeds the maximum rating (20000 rpm) when the number a of used beams is three. Further, when the number a of used beams is two, the pixel clock frequency after change (60 MHz) exceeds the maximum rating (40 MHz).

Therefore, when the number a of used beams is three or two, image forming may be continued with the system speed changed based on the above formula (3) while the pixel clock frequency and the number of polygon mirror revolutions are maintained at the initial values.

With the above control, however, the system speed becomes 150 mm/s or 100 mm/s, with which the aimed print productivity of 80 sheets/min. cannot be achieved. In this case, a call for service maintenance is displayed on the control panel of the image forming apparatus. When it is impossible to achieve the aimed print productivity, replacement of the scanning optical unit is necessary.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

For example, the structure of the laser diode array for emitting multibeam and that of the optical system for deflecting and scanning beams may be modified. Further, the detailed structure of the control system shown in FIG. 1 may be modified.

What is claimed is:

1. A multibeam scanning optical apparatus for forming an image on a photosensitive member by irradiating the photosensitive member with beams at predetermined intervals in a secondary scanning direction, the beams being emitted from a plurality of beam generating elements spaced at predetermined intervals in a direction, the apparatus comprising:

a plurality of memory portions each for storing image data for a respective one of the beam generating elements line by line;

a determiner for checking the light emission state as to whether each of the beam generating elements operates normally or suffers a failure and for specifying the beam generating elements operating normally and arranged in a continuous row which are the largest in number of beam generating elements when at least one of the beam generating elements suffers a failure;

a memory controller for controlling writing and reading of image data with respect to the memory portions, the memory controller causing the image data to be written in and read out successively line by line only with respect to the memory portions corresponding to the specified beam generating elements specified by the determiner;

a driver for controlling the light emission of the beam generating elements, the driver performing the light emission control only with respect to the specified beam generating elements specified by the determiner;

a deflector controller for controlling the number of revolutions of a deflector for deflecting and scanning a plurality of beams, the deflector controller being capable of changing the number of revolutions of the deflector depending on the number of the specified beam generating elements specified by the determiner; and a pixel clock controller for controlling a pixel clock frequency, the pixel clock controller being capable of changing the pixel clock frequency depending on the number of the specified beam generating elements specified by the determiner.

2. A multibeam scanning optical apparatus as claimed in claim 1, wherein when the determiner specifies which of the beam generating elements are operating normally and arranged in a continuous row, the pixel clock frequency and the number of revolutions of the deflector are controlled based on the formulae (1), (2) given below:

$$\text{Pixel clock frequency}=\text{Initial pixel clock frequency}\times(m/a) \quad (1)$$

$$\text{Number of revolutions of deflector}=\text{Initial number of revolutions}\times(m/a) \quad (2)$$

where "m" represents the number of beam generating elements arranged in advance, and "a" represents the number of beam generating elements which are operating normally and arranged in a continuous row.

3. A multibeam image forming apparatus for forming an image on a photosensitive member by irradiating the photosensitive member with beams at predetermined intervals in a secondary scanning direction, the beams being emitted from a plurality of beam generating elements spaced at predetermined intervals in a direction, the apparatus comprising:

a plurality of memory portions each for storing image data for a respective one of the beam generating elements line by line;

a determiner for checking the light emission state as to whether each of the beam generating elements operates normally or suffers a failure and for specifying the beam generating elements operating normally and arranged in a continuous row which are the largest in number of beam generating elements when at least one of the beam generating elements suffers a failure;

a memory controller for controlling writing and reading of image data with respect to the memory portions, the memory controller causing the image data to be written in and read out successively line by line only with respect to the memory portions corresponding to the specified beam generating elements specified by the determiner;

a driver for controlling the light emission of the beam generating elements, the driver performing the light emission control only with respect to the specified beam generating elements specified by the determiner; and a system speed controller for controlling system speed of the image forming apparatus, the system speed controller being capable of changing the system speed depending on the number of the specified beam generating elements specified by the determiner.

4. A multibeam scanning optical apparatus as claimed in claim 3, wherein when the determiner specifies which of the beam generating elements are operating normally and arranged in a continuous row, the system speed controller is controlled based on the formulae (3) given below:

$$\text{System speed}=\text{Initial system speed}\times(a/m) \quad (3)$$

where "m" represents the number of beam generating elements arranged in advance, and "a" represents the number of beam generating elements which are operating normally and arranged in a continuous row.

5. A multibeam image forming apparatus for forming an image on a photosensitive member by irradiating the photosensitive member with beams at predetermined intervals in a secondary scanning direction, the beams being emitted from a plurality of beam generating elements spaced at predetermined intervals in a direction, the apparatus comprising:

a plurality of memory portions each for storing image data for a respective one of the beam generating elements line by line;

a determiner for checking the light emission state as to whether each of the beam generating elements operates normally or suffers a failure and for specifying the beam generating elements operating normally and arranged in a continuous row which is the largest in number of beam generating elements when at least one of the beam generating elements suffers a failure;

a memory controller for controlling writing and reading of image data with respect to the memory portions, the memory controller causing the image data to be written in and read out successively line by line only with respect to the memory portions corresponding to the specified beam generating elements specified by the determiner;

a driver for controlling the light emission of the beam generating elements, the driver performing the light emission control only with respect to the specified beam generating elements specified by the determiner;

a deflector controller for controlling the number of revolutions of a deflector for deflecting and scanning a plurality of beams, the deflector controller being capable of changing the number of revolutions of the deflector depending on the number of the specified beam generating elements specified by the determiner;

a pixel clock controller for controlling a pixel clock frequency, the pixel clock controller being capable of changing the pixel clock frequency depending on the number of the specified beam generating elements specified by the determiner; and a system speed controller for controlling system speed of the image forming apparatus, the system speed controller being capable of changing the system speed depending on the number of the specified beam generating elements specified by the determiner.

6. A multibeam scanning optical apparatus as claimed in claim 5, wherein when the determiner specifies which of the beam generating elements are operating normally and arranged in a continuous row, the pixel clock frequency and the number of revolutions of the deflector are controlled based on the formulae (1), (2) given below, while the initial system speed is maintained:

$$\text{Pixel clock frequency} = \text{Initial pixel clock frequency} \times (m/a) \quad (1)$$

$$\text{Number of revolutions of deflector} = \text{Initial number of revolutions} \times (m/a) \quad (2)$$

where "m" represents the number of beam generating elements arranged in advance, and "a" represents the number of beam generating elements which are operating normally and arranged in a continuous row.

7. A multibeam scanning optical apparatus as claimed in claim 6, wherein when the value obtained by the formula (1) exceeds a maximum rated pixel clock frequency or when the value obtained by the formula (2) exceeds the maximum rated number of revolutions of the deflector, the pixel clock frequency and the number of revolutions of the deflector are maintained at the initial values, and the system speed is controlled based on the formula (3) given below:

$$\text{System speed} = \text{Initial system speed} \times (a/m) \quad (3).$$

8. A multibeam scanning optical apparatus for forming an image on a photosensitive member by irradiating the photosensitive member with a plurality of beams, said apparatus comprising:

a controller which specifies laser diodes which are emitting light normally and arranged in a continuous row;

a memory having a plurality of area in which image data are stored, the plurality of areas corresponding in number to the plurality of beams;

a write-in controller which causes image data for each line to be written into only areas of the memory corresponding to the specified laser diodes when any of the laser diodes suffers a failure;

a read-out controller which causes the image data for each line to be read out simultaneously from the areas of memory corresponding to the specified laser diodes; and a driver which performs light emission control only with respect to the specified laser diodes.

9. A multibeam forming apparatus as claimed in claim 8, wherein said controller specifies laser diodes arranged in a continuous row which are the largest in number of laser diodes.

* * * * *